United States Patent [19]

Ikemoto et al.

[11] Patent Number: 4,809,033

[45] Date of Patent: Feb. 28, 1989

[54] IMAGE FORMING APPARATUS AND PROCESS CARTRIDGE THEREFOR

[75] Inventors: Isao Ikemoto, Kawasaki; Shinji Kanemitsu; Morikazu Mizutani, both of Tokyo; Hajime Kitajima; Shigeyoshi Onoda, both of Yokohama, all of Japan

[73] Assignee: Canon Kabushiki Kaisha, Tokyo, Japan

[21] Appl. No.: 63,078

[22] Filed: Jun. 17, 1987

[30] Foreign Application Priority Data

Jun. 19, 1986 [JP] Japan ..... 61-143708

[51] Int. Cl.[4] ..... G03G 15/00

[52] U.S. Cl. ..... 355/3 SH; 355/3 DR; 355/14 SH

[58] Field of Search ..... 355/3 TR, 3 SH, 14 SH, 355/3 DR, 3 R, 3 DD

[56] References Cited

U.S. PATENT DOCUMENTS

| | | | |
|---|---|---|---|
| 4,116,556 | 9/1978 | Tanaka et al. | 355/3 SH |
| 4,260,236 | 4/1981 | Tsuda et al. | 355/3 TR |
| 4,286,861 | 9/1981 | Matsumoto | 355/3 R |
| 4,386,845 | 6/1983 | Miyoshi et al. | 355/15 |
| 4,464,042 | 8/1984 | Omori et al. | 355/3 SH |
| 4,478,506 | 10/1984 | Miyoshi et al. | 355/3 TR X |
| 4,531,823 | 7/1985 | Deguchi et al. | 355/3 TR X |
| 4,583,844 | 4/1986 | Honda | 355/3 SH |
| 4,585,324 | 4/1986 | Koyama et al. | 355/3 DR X |
| 4,609,276 | 9/1986 | Mitzutani | 355/3 R |

FOREIGN PATENT DOCUMENTS

| | | |
|---|---|---|
| 2915649A1 | 11/1979 | Fed. Rep. of Germany . |
| 58-25651A | 2/1983 | Japan . |

*Primary Examiner*—A. C. Prescott
*Assistant Examiner*—Jane Lav
*Attorney, Agent, or Firm*—Fitzpatrick, Cella, Harper & Scinto

[57] ABSTRACT

An image forming apparatus wherein an image formed on an image bearing member is transferred onto a transfer material includes a feeder for feeding the transfer material to an image transfer station wherein the image is transferred from the image bearing member onto the transfer material; a guiding member for guiding the transfer material fed from the feeder to the transfer station in a guiding direction; a guide support for supporting the guiding member for movement in the guiding direction and in a direction transverse with the guiding direction; and an image bearing member supporting member for supporting the image bearing member for movement between a first position wherein the image forming apparatus is operable and a second position which is different from the first position, the image bearing member supporting member having an engaging portion for engagement with a part of the guiding member to correctly position the guiding member when the image bearing member supporting member takes its first position.

21 Claims, 3 Drawing Sheets

IMAGE FORMING APPARATUS AND PROCESS CARTRIDGE THEREFOR

FIELD OF THE INVENTION AND RELATED ART

The present invention relates to an image forming apparatus and a process cartridge usable therewith. More particularly, it relates to a so-called image transfer type image forming apparatus wherein an image (visualized toner image or latent image) is produced through a known image forming process such as an electrophotographic process and an electrostatic recording process, on an image bearing member such as a photosensitive member or a dielectric member, from which the image is transferred onto a transfer material which is fed to the image bearing member.

In such a transfer type image forming apparatus, the transfer material fed from a feeding station is guided to the image bearing member by a transfer material guide member and is introduced to an image transfer station, where it receives the image from the image bearing member.

The positioning of the transfer material guide member with respect to the image bearing member, more particularly, the clearance from the image bearing member, the horizontal position and vertical position, is one of most important factors to be considered in order to provide good images. If the positional relationship between the image bearing member and/or the transfer guide is not proper, it is not assured that an entering position or an entering angle of the leading edge of the transfer material to the surface of the image bearing member are stabilized or that the transfer material is stably transported through the transfer station. As a result, unsatisfactory image transfer such as local void of the transferred image occurs; that toner is scattered to the non-image portion; and that the image is disturbed. Thus, satisfactory images are not provided.

Conventionally, the positioning of the transfer material guide has been accomplished in the following manner. The guide member is manually adjusted with respect to the image bearing member, using a proper spacer with reference to the surface of the image bearing member mounted at a predetermined position in the apparatus; and then, the guide is fixedly secured to the adjusted position. However, this is cumbersome and inefficient.

As an improvement, a proposal has been made wherein, as shown in FIG. 7, a transfer guide 24 is pivotably mounted about a pivot 35 and is normally urged in a predetermined direction, and a part of the guide is abutted to a positioning abutment 37 formed in a part of a supporting member for supporting the image bearing member 1 by an urging spring 36 for providing the normal urging, so that the guide 24 is supported in place with respect to the image bearing member 1. This method is disclosed, for example, in U.S. Pat. Nos. 4,386,845; 4,464,042; 4,116,556 and 4,609,276.

However, the improved method has not been found to be satisfactory. One reason is that in practice, there are practice variations in the distance between the pivot 35 of the guide 24 and the free end 24*a* of the guide member as shown in FIG. 7 by solid lines and chain lines, due to more or less manufacturing variations. Another reason is that the position of the pivot 35 varies in practice, resulting from unavoidable errors in assembling. Because of those variations and/or errors, the accuracy in the pose or position of the guide 24 in the horizontal direction with respect to the image bearing member as indicated by $\Delta x$ and that in the vertical direction $\Delta y$ are easily influenced by the manufacturing variation of the guide member and the setting variation of the pivot, although the clearance d between the surface of the image bearing member 1 and the free end 24*a* of the guide 24 is assured.

SUMMARY OF THE INVENTION

Accordingly, it is a principal object of the present invention to provide an image forming apparatus, more particularly, a transfer type image forming apparatus wherein a transfer material guiding member is correctly positioned without difficulty with respect to an image bearing member, whereby satisfactory images can always to be produced.

It is a further object of the present invention to provide a positioning structure for easily and simply positioning a transfer material guide member with respect to an image bearing member with precision.

It is a further object of the present invention to provide a process cartridge suitable for the positioning structure.

According to an embodiment of the present invention, there is provided an image transfer type image forming apparatus, wherein a transfer material guide member for guiding a transfer material fed from a transfer material feeding station to the image bearing member is made pivotable about a pivot and is made slidable in a plane containing the guiding surface of the guide member, that is, in the direction of a transfer material transportation, and wherein a part of the guide member is engaged and held by a positioning portion correctly formed at a predetermined position in a supporting member for supporting the image bearing member with respect to the image bearing member. A process cartridge may be used which contains the image bearing member and which is detachably mountable into the image forming apparatus. The process cartridge may be provided with a positioning portion engageable with the transfer guide member.

Since the transfer guide member is pivotably and slidably supported, then when the predetermined part of the transfer material guide member is engaged with the positioning portion correctly formed in the image bearing member supporting member, the guide member pivots by a proper amount to provide correct vertical position and pose, and additionally, the guide member advances or retracts due to its slidability to provide a correct horizontal position and pose, and furthermore, the clearance between the image bearing member surface and the free end of the guide member is correctly set.

In other words, simply by engaging the predetermined portion of the guide member to or with the positioning portion of the image bearing member supporting member, all the three conditions, the clearance between the image bearing member surface and the free end of the guide member, the horizontal pose of the guide member with respect to the image bearing member and the vertical pose thereof are simultaneously and accurately satisfied, in addition, the satisfactory conditions are maintained stably.

DETAILED DESCRIPTION OF THE PREFERRED EMBODIMENTS

Figure 1:
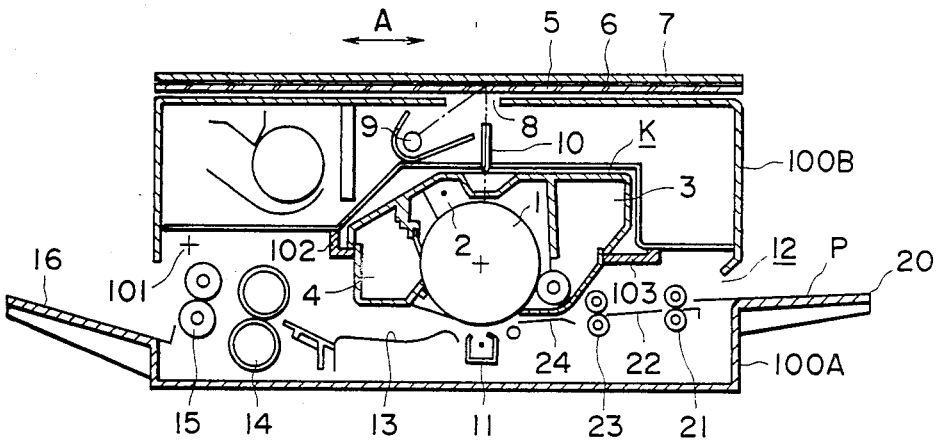
FIG. 1 is a sectional view of an image forming apparatus according to an embodiment of the present invention.

Referring to FIG. 1, there is shown an image forming apparatus in cross section according to an embodiment of the present invention.

In this embodiment, the image forming apparatus is an image transfer type electrophotographic copying apparatus, wherein the copying apparatus is separable into a bottom assembly 100A and a top assembly 100B. The top assembly 100B is pivotable about a hinge 101 with respect to the bottom assembly 100A, so that the top assembly 100B is closed or opened in connection with the bottom assembly 100A. In FIG. 1, the copying apparatus is illustrated as being closed, that is, the upper body 100B and the lower body 100A are combined and locked, in which state, the copying operation can be performed.

Figure 2:
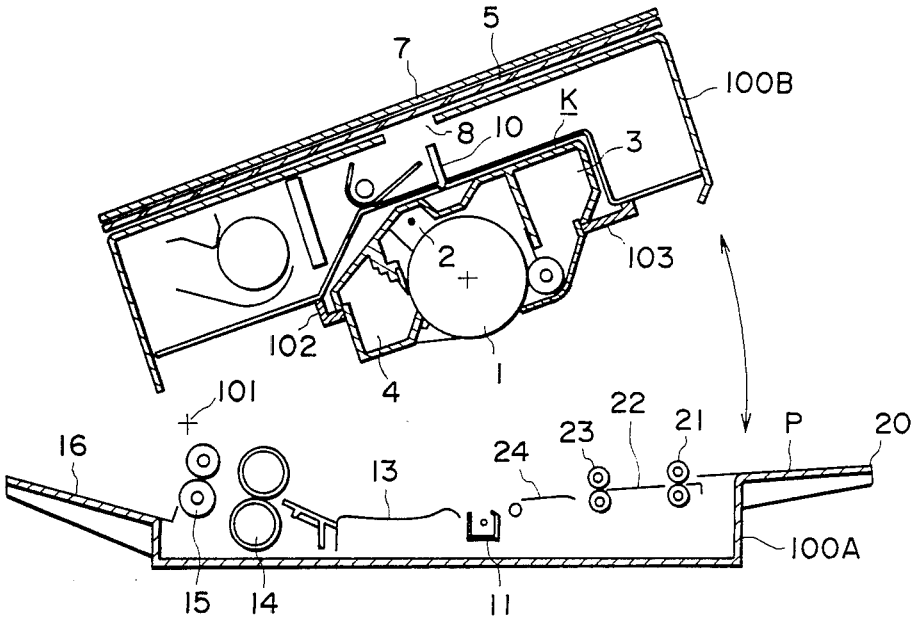
FIG. 2 is a sectional view of the image forming apparatus of FIG. 1 wherein the upper assembly thereof is at its open position.

FIG. 2 shows the open position, wherein the upper assembly 100B is pivoted in the counterclockwise direction after the lock has been released. It will be understood that with this open state, the inside of the apparatus is accessible to facilitate inspection, servicing and jam disposal without difficulty.

The copying apparatus in this embodiment comprises a photosensitive drum 1 functioning as the image bearing member, a discharger for uniformly charging the photosensitive drum 1 to a positive or negative polarity, a developing device 3, and a cleaning device 4, which are all contained as a unit in a process cartridge K. The process cartridge K is detachably mountable into a predetermined position of the upper assembly 100B along guiding rails 102 and 103, when the top assembly 100B is opened from the bottom assembly 100A.

As shown in FIG. 1, the copying apparatus further includes a reciprocable original supporting platen glass 5 for carrying an original to be copied, the platen 5 being reciprocable in the horizontal direction, as indicated by double-headed arrow A, by an unshown driving mechanism. Designated by reference numeral 7 is a original pressing plate which is used to press the original on the platen glass 5. The original 6 to be copied is placed face down on the platen glass 5 at a reference position.

The surface of the original 6 set on the platen 5 is illuminated and scanned through a slit by continuously passing by the illuminating station 8 during a forward or backward stroke of the original supporting glass 5 whichever is the scanning stroke. Designated by reference 9 is a source of illumination. The light reflected by the bottom surface of the original through the slit illumination is imaged continuously on the rotating photosensitive drum 1 surface by an imaging lens (array of short focus imaging elements). The photosensitive drum 1 is exposed to the image.

Before the photosensitive drum is exposed to the image, it is subjected to a uniform positive or negative charging by the discharger 2. Therefore, by the image exposure an electrostatic latent image is formed continuously on the surface of the photosensitive drum in correspondence with the original.

The surface of the drum 1 now having the latent image is passed by the developing device 3 so that the latent image is continuously developed.

The developed image on the drum 1 is carried to the position of the transfer discharger 11. A transfer material P is fed from a transfer material feeding station 12 into a space between the drum 1 and the transfer corona discharger 11 in synchronism with rotation of the drum 1. The developed image is transferred onto a surface of the transfer material P from the drum 1 continuously.

The transfer material or a copy material P now having the transferred image is separated from the surface of the drum 1 by an unshown separating means and is then transported along a guide 13 into an image fixing device 14, where the image is fixed on the transfer material. Then, the transfer material is discharged by a discharge roller 15 onto a discharge tray 16, as a reproduction or copy.

The surface of the drum 1 from which the transfer material has been separated is passed by the cleaning device 4, by means of which the residual developer is removed, and the drum surface is used repeatedly for image formation.

The transfer material feeding station 12 includes a manual feeding tray 20 for manually feeding the transfer material or materials, a couple of feeding rollers 21, a couple of registration rollers 23 first transfer material guide member 22 disposed between the feeding roller couple 21 and the registration roller couple 23 and a second transfer material guide member 24 disposed between the registration roller couple 23 and the photosensitive drum 1.

The transfer material P inserted into the copying apparatus on the feed tray 20 is pulled into the copying apparatus by the transportation roller couple 21, and the leading edge thereof is received by a nip formed by the couple of registration rollers 23 which are then at rest. The registration roller couple 23 starts rotating at a predetermined time related to the rotation of the photosensitive drum 1, by which the transfer material P is advanced toward the photosensitive drum 1 along the guide member 24 and is introduced into the transfer station constituted between the photosensitive drum 1 and the transfer charger 11. The feeding table 20 may be a cassette or deck containing a number of stacked transfer materials.

As described hereinbefore, in order to obtain a good transferred image, the positional relationship between the second guide member 24 and the photosensitive drum 1 is important.

As will be understood from FIG. 2, the bottom assembly 100A is provided with the transfer material feeding station 12 comprising elements 20–24, the transfer charger 11, the guide 13, the image fixing device 14, the discharge roller 15, the tray 16 and other elements, whereas the top assembly 100B contains a reciprocable original supporting glass 5, the original illuminating light source 9, the array 10 of the imaging elements, the above-described process cartridge K and other elements.

Figure 3:
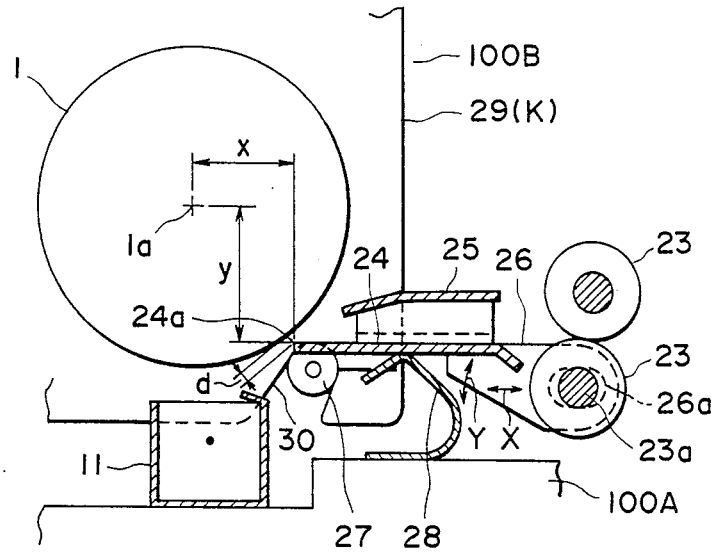
FIG. 3 is an enlarged sectional view illustrating a transfer material guide member which is retained in a predetermined positional relationship with respect to an image bearing member.

FIG. 3 shows details of the structure for setting the second transfer guide member 24 in the copying apparatus. The transfer material guide member 24 is provided with an upper guide member 25 integral therewith.

The guide member 24 has arm plates 26 at the rear and front sides of the apparatus. Each of the arm plates 26 is provided with a more or less elongated slot 26*a* which is engaged with a shaft 23*a* of a bottom one of the registration rollers 23. Therefore, the guide member 24 is pivotable in the vertical direction Y about a pivot of the shaft 23*a*, and simultaneously, it is slidable within the range of the elongated slot 26*a* in the direction X of the plane of the guide member (perpendicular to the shaft 23*a*).

The guide member 24 is provided at the rear and front sides adjacent the leading side 24*a* with a positioning roller 27. An urging spring 28 has a bottom end fixed to an unstationary member of the bottom assembly 100A and a top end abutted to a bottom face of the guide member 24, and is effective to normally urge the guide member 24 upward. The guide member 24 is normally urged by this spring member 28 in the clockwise direction about the shaft 23*a*. The process cartridge K has supporting members 29 for supporting the photosensitive drum at the rear and front sides of the photosensitive drum. Each of the supporting member 29 is provided with an open elongated slot 30 for positioning the positioning roller 27 of the guide member 24 when engaged with the roller 27. The position of the open and elongated slot 30 is correctly at the predetermined with respect to the drum center 1A of the photosensitive drum 1 contained in the process cartridge K. For example, when the outer casing of the process kit K is made by injection molding of a resin material, it can be positioned with the accuracy of ±0.05 mm.

In FIG. 3, the top assembly 100B loaded with the process cartridge K is closed to the bottom assembly 100A and is locked therewith. In this state, the photosensitive drum supporting member 29 of the process cartridge K takes a lower position so that the positioning roller 27 of the guide member 24 is engaged with the slot 30 of the supporting member 29. Thus, the roller 27 is pressed down by the supporting member 29, whereby the guide member 24 moves downward about the shaft 23*a* against the spring force of the spring member 28, and the engagement between the roller 27 and the slot 30 is assured by the spring force stably.

A during this engaging action, the engagement between the elongated slot 30 and the roller 27 provides a reference, with which the guide member 24 is rotated through an angle about the shaft 23*a* in the Y-direction so that a predetermined vertical positioning accuracy is assured, whereas the guide member 24 is slidingly advanced or retracted in the X direction so that the horizontal positioning accuracy is assured, with the assured clearance between the photosensitive drum 1 and the leading edge 24*a* of the guide member 24. Finally, the positionings are determined by the final engagement between the end of the slot 30 and the roller 27. In this manner, simply by closing the top assembly 100B to the bottom assembly 100A, the guide member 24 is automatically set with respect to the photosensitive drum 1 with predetermined high positioning accuracies in the X and Y directions with the clearance d.

Figure 4:
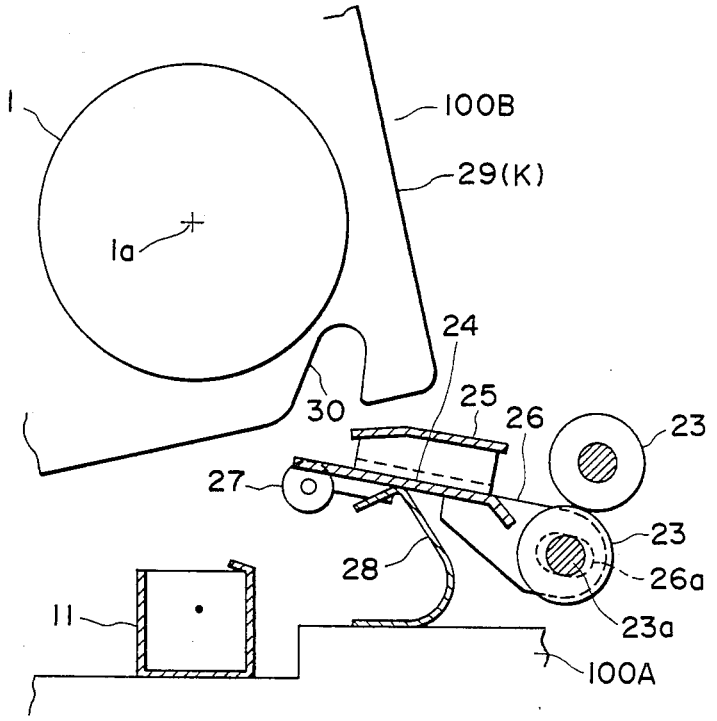
FIG. 4 is a sectional view similar to FIG. 3, but the guide member is released.

When the top assembly 100B is unlocked and opened from the bottom body 100A, the process cartridge K moves up together with the top assembly 100B away from the transfer material feeding station 12 of the bottom assembly 100A. During the initial sage of the opening action of the top assembly 100B, as shown in FIG. 4, the positioning open slot 30 of the photosensitive drum supporting member 29 of the process cartridge K is released upwardly from the positioning roller 27. By this, the roller 27 becomes free from the slot 30 so that the guiding member 24 is urged upwardly and in the counterclockwise direction by the spring 28 about the shaft 23*a*, and therefore it is slightly moved upward and is retained there. The top assembly 100B can be continuously opened to a predetermined satisfactory extent.

When the top assembly 100B is closed again, the relative positioning relationship between the photosensitive drum 1 and the guide member 24 is brought back automatically into the state shown in FIG. 3, and the state is maintained.

In order to cause the transfer material to be guided adjacent the leading end of the guide member 24, a guiding roller may be mounted adjacent to the leading end 24*a* of the guide member 24. In this case, both end portions of the guiding roller may take the place of the positioning roller 27.

Figure 5:
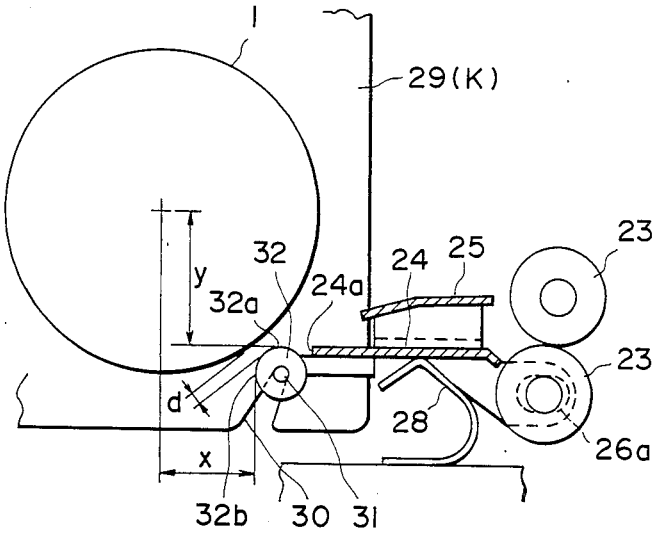
FIGS. 5 and 6 are sectional views of the transfer guide according to another embodiment of the present invention.

FIG. 5 shows this example, wherein a shaft 31 is journaled to the guide member 24 adjacent its leading end 24*a* so as to extend parallel to the leading end. To this shaft 31 a transfer material guiding roller 32 is mounted. The end portions of the shaft 31 are used as a positioning member on the guide member 24 side. The end portions of the shaft 31 are engageable with the open and elongated positioning slot 30 of the photosensitive drum supporting member 29. In this embodiment, the leading end of the guide member 24 is in effect the surfaces 32*a* and 32*b* of the guide roller 32. When it is desired or necessary that the roller 32 is driven, the driving force may be applied thereto from the photosensitive drum 1 since the positioning is precise in the system of the present invention.

Figure 6:
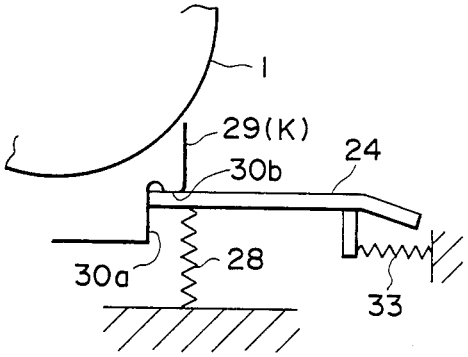

FIG. 6 shows another embodiment, wherein the positioning portion of the photosensitive drum supporting member 29 is, in place of the elongated slot 30, constituted by abutments 30*a* and 30*b* for receiving the leading end surface and the top surface of the guide member at the leading end 24*a* thereof, at each of rear and front sides. The guide member 24 is positioned in the horizontal and vertical directions by engaging it to the abutments 30*a* and 30*b*. To ensure the engagements, the guide member 24 is urged by springs 28 and 33. As for the image forming apparatus to which the present invention is applicable, there are in addition to an electrophotographic copying apparatus, printer or facsimile machines using a laser beam or LED (light emitting diode) elements.

Figure 7:
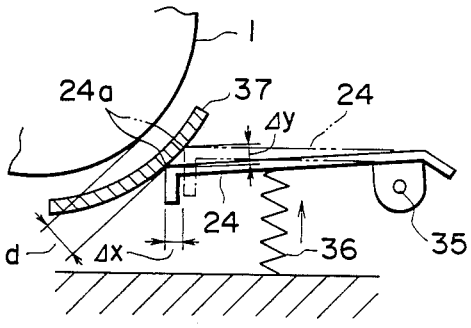
FIG. 7 PRIOR ART
FIG. 7 is a sectional view illustrating a conventional structure for the transfer guide positioning mechanism.

Thus, according to the embodiment of this invention, the transfer material guiding member 24 is movable substantially independently in two directions, i.e., the direction of transfer material movement toward the transfer station and in the direction substantially perpendicular to the surface of the transfer material being advanced to the transfer station, as contrasted to the case of FIG. 7, wherein the free end of the transfer material guide 24*a* is movable in such two directions, but the movements in the two directions are not independent since it is only rotatable about the pivot 35, in other words, a movement in one direction is determined if a movement in the other direction is determined. Therefore, according to this invention, the transfer material guide 24 can be correctly positioned in both two directions. More particularly, in FIG. 7 arrangement, the position of the free end 24*a* is different due to an avoidable error or tolerance in the manufacturing, as shown in FIG. 7, that is, the position of contact between the element 37 and the free end 24*a* varies. However, in the present invention, the position does not vary as will be understood from FIGS. 5 and 6.

As for the process cartridge to which the present invention is applicable, it can contain as the process means an electrophotographic photosensitive member, corona discharger, developing device and a cleaning device in the disclosed embodiment. However, as shown in U.S. Pat. No. 4,609,276, it may contain an image bearing member and at least one of the other process means, for example a photosensitive member and a cleaning device, or a photosensitive member and a developing device. The process cartridge has been explained as being completely detachable from the top assembly, however, it may be partly withdrawn from the apparatus as disclosed in U.S. Pat. No. 4,286,861.

As described in the foregoing, according to the present invention, the transfer guide member can be placed correctly with respect to the image bearing member by simple structure.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus wherein an image formed on an image bearing member is transferred onto a transfer material, comprising:

means for feeding the transfer material to an image transfer station wherein the image is transferred from the image bearing member onto the transfer material;

a guiding member for guiding the transfer material fed from said feeding means to the transfer station in a guiding direction;

a guide supporting means for supporting said guiding member for movement in said guiding direction and in a crossing with said guiding direction; and an image bearing member supporting member for supporting said image bearing member for movement between a first position wherein said image forming apparatus is operable and a second position which is different from said first position, said image bearing member supporting member having an engaging portion for engagement with a part of said guiding member to correctly position said guiding member when said image bearing member supporting member takes its first position.

2. An apparatus according to claim 1, further comprising a spring for normally urging said guiding member.

3. An image forming apparatus wherein an image formed on an image bearing member is transferred onto a transfer material, comprising:

means for feeding the transfer material to an image transfer station wherein the image is transferred from the image bearing member onto the transfer material;

a guiding member for guiding the transfer material fed from said feeding means to the transfer station in a guiding direction, said guiding means having an elongated slot extending substantially in said guiding direction;

a spring for normally urging said guiding member;

a guide supporting means for supporting said guiding member for movement in said guiding direction and in a direction crossing with said guiding direction, said guide supporting member having a shaft fixed on said apparatus, which is engaged with the elongated slot of said guiding member; and an image bearing member supporting member for supporting said image bearing member for movement between a first position wherein said image forming apparatus is operable and a second position which is different from said first position, said image bearing member supporting member having an engaging portion for engagement with a part of said guiding member to correctly position said guiding member when said image bearing member supporting member takes its first position.

4. An apparatus according to claim 1, further comprising a first spring for urging said guiding member in said guiding direction and a second spring for urging said guiding member in the crossing direction.

5. An apparatus according to claim 1, wherein said apparatus is separable into upper and lower assemblies, and said image bearing member supporting member is provided in said upper assembly.

6. An apparatus according to claim 5, wherein said image bearing member supporting member is movable relative to the upper assembly.

7. An apparatus according to claim 5, wherein said image bearing member supporting member supports as a unit process means actable on said image bearing member, and the image bearing member supporting member constitutes a process cartridge together with the image bearing member and said process means.

8. An apparatus according to claim 1, wherein said positioning portion of said image bearing member supporting member is formed by a recess engageable with the part of said guiding member.

9. An image forming apparatus wherein an image formed on an image bearing member is transferred onto a transfer material, comprising:

an upper assembly;

a lower assembly movable relative to said second assembly;

a guiding member for guiding the transfer material to a transfer station in a guiding direction;

a guide supporting means, provided in said lower assembly, for supporting said guiding member for movement in said guiding direction and in a direction crossing with said guiding direction;

an image bearing member supporting member for supporting said image bearing member, said image bearing member supporting member having an engaging portion for engagement with a part of said guiding member to correctly position said guiding member when said upper assembly is engaged with said lower assembly for operation of said apparatus.

10. An apparatus according to claim 9, further comprising a spring for normally urging said guiding member in a direction of upward movement of said upper assembly.

11. An image forming apparatus wherein an image formed on an image bearing member is transferred onto a transfer material, comprising:

an upper assembly;

a lower assembly movable relative to said second assembly;

a guiding member for guiding the transfer material to a transfer station in a guiding direction, said guiding member having an elongated slot extending substantially in said guiding direction;

a spring for normally urging said guiding member in a direction of upward movement of said upper assembly;

a guide supporting means, provided in said lower assembly, for supporting said guiding member for movement in said guiding direction and in a direction crossing with said guiding direction, said guide supporting member having a shaft fixed on said lower assembly, which is engaged with the elongated slot of said guiding member; and an image bearing member supporting member for supporting said image bearing member, said image bearing member supporting member having an engaging portion for engagement with a part of said guiding member to correctly position said guiding member when said upper assembly is engaged with said lower assembly for operation of said apparatus.

12. An apparatus according to claim 9, further comprising a first spring for urging said guiding member in said guiding direction and a second spring for urging said guiding member in the crossing direction upward.

13. An apparatus according to claim 10, wherein said image bearing member supporting member is movable relative to said upper assembly.

14. An apparatus according to claim 10, wherein said image bearing member supporting member supports as a unit process means actable on said image bearing member, and the image bearing member supporting member constitutes a process cartridge together with the image bearing member and said process means.

15. An apparatus according to claim 10, wherein said engaging portion of said image bearing supporting member is formed by a recess engageable with the part of said guiding member.

16. An apparatus according to claim 15, wherein said recess receives during engaging movement of said upper assembly to said lower assembly, receives the part of said guiding member.

17. An apparatus according to claim 16, wherein said recess constitutes a slot opening downwardly.

18. A process cartridge detachably mountable to and cooperable with an image forming apparatus to form an image on a transfer material fed along a transfer material guide of said image forming apparatus comprising:

an image bearing member;

process means for forming an image on said image bearing member;

an abutment for engagement with a part of the transfer material guide at fixed positions both in substantially horizontal direction and in substantially vertical direction.

19. A process cartridge detachably mountable to an cooperable with an image forming apparatus to form an image on a transfer material fed along a transfer material guide of said image forming apparatus, comprising:

an image bearing member;

process means for forming an image on said image bearing member; and an image bearing member supporting member for supporting said image bearing member together with said process means, said image bearing member supporting member having an elongated recess for receiving and positioning relative to said process cartridge a part of the transfer material guide.

20. A process cartridge detachably mountable to and cooperable with an image forming apparatus to form an image on a transfer material fed along a transfer material guide of said image forming apparatus, comprising:

an image bearing member;

process means for forming an image on said image bearing member;

an image bearing member supporting member for supporting said image bearing member together with said process means, said image bearing member supporting member having a recess for engagement with a part of said guiding member to correctly position said guiding member in a direction of movement of the transfer material and also in a direction crossing therewith.

21. An apparatus according to claim 20, wherein said recess has a recess end in conformity with the part of said guiding member.

* * * * *

UNITED STATES PATENT AND TRADEMARK OFFICE

CERTIFICATE OF CORRECTION

PATENT NO. : 4,809,033

DATED : February 28, 1989

INVENTOR(S) : ISAO IKEMOTO, ET AL.

It is certified that error appears in the above-identified patent and that said Letters Patent is hereby corrected as shown below:

Column 1, line 62, "practice" should be deleted.

Column 5, line 35, "with" should read --location with--;

line 52, "A during" should read --During--.

Column 7, line 48, "a" should read --a detection--.

Column 8, line 49, "second" should read --upper--.

Column 9, line 5, "second" should read --upper--.

UNITED STATES PATENT AND TRADEMARK OFFICE

CERTIFICATE OF CORRECTION

PATENT NO. : 4,809,033

DATED : February 28, 1989

INVENTOR(S) : ISAO IKEMOTO, ET AL.

It is certified that error appears in the above-identified patent and that said Letters Patent is hereby corrected as shown below:

Column 10, line 1, "receives" should be deleted;

line 16, "an" should read --and--.

Signed and Sealed this

Twenty-second Day of August, 1989

*Attest:*

*Attesting Officer*

DONALD J. QUIGG

*Commissioner of Patents and Trademarks*